US009845583B1

(12) United States Patent
Tsai

(10) Patent No.: US 9,845,583 B1
(45) Date of Patent: Dec. 19, 2017

(54) GEOTEXTILE TUBE

(71) Applicant: Gold-Joint Industry Co., Ltd., Taichung (TW)

(72) Inventor: Wei-Che Tsai, Taichung (TW)

(73) Assignee: Gold-Joint Industry Co., LTD., Taichung (TW)

( * ) Notice: Subject to any disclaimer, the term of this patent is extended or adjusted under 35 U.S.C. 154(b) by 0 days.

(21) Appl. No.: 15/240,542

(22) Filed: Aug. 18, 2016

(51) Int. Cl.
*E02B 7/00* (2006.01)
*E02B 3/12* (2006.01)

(52) U.S. Cl.
CPC ..... *E02B 3/127* (2013.01); *E02B 3/121* (2013.01)

(58) Field of Classification Search
CPC . E02B 3/12; E02B 3/121; E02B 3/122; E02B 3/00; E02B 5/08; E02B 7/00; E02B 3/10; E02B 3/108; E02B 7/14; E02B 3/16; E02B 7/005; E02D 31/06
USPC ..... 405/16, 17, 19, 80, 107, 111, 112, 114, 405/115, 302.6
See application file for complete search history.

(56) References Cited

U.S. PATENT DOCUMENTS 4,729,691 A * 3/1988 Sample ..... E02B 3/06 405/15
4,966,491 A * 10/1990 Sample ..... E02B 3/04 405/15
4,983,068 A * 1/1991 Kozak ..... E01F 5/00 383/107
5,158,395 A * 10/1992 Holmberg ..... E02B 3/127 405/15
5,902,070 A * 5/1999 Bradley ..... E02B 3/04 112/441
6,010,622 A * 1/2000 Chinn ..... B01D 29/05 210/164
7,097,390 B1 * 8/2006 Moss ..... E02B 3/127 405/262
7,357,598 B1 * 4/2008 Bradley ..... E02B 3/108 405/111
7,454,847 B1 * 11/2008 Miller ..... F26B 5/14 34/397
8,777,523 B2 7/2014 Stephens et al.
2002/0131826 A1 * 9/2002 Spangler ..... E02B 3/04 405/302.4
2002/0178987 A1 * 12/2002 Eagles ..... B63C 3/06 114/219
2004/0140041 A1 * 7/2004 Glick ..... B29C 73/025 156/94
2004/0146359 A1 * 7/2004 Doolaege ..... E02B 3/108 405/115

(Continued)

*Primary Examiner* — Amber R Anderson
*Assistant Examiner* — Edwin J Toledo-Duran
(74) *Attorney, Agent, or Firm* — LeClairRyan

(57) ABSTRACT

A geotextile tube includes a bag unit, an extending unit, a main stitch seam, and two auxiliary stitch seams. The bag unit includes a tubular wall and an end wall cooperatively defining a filling space. The extending unit includes two extending parts respectively extending from opposite lateral sides of the end wall and each defining a buffering space. The main stitch seam extends from one of the extending parts to the other one of the extending parts for sealing the filling space. The auxiliary stitch seams intersect the main stitch seam, and are respectively disposed at the lateral sides of the end wall such that the end wall is substantially flat. Each auxiliary stitch seam separates an adjacent buffering space from the filling space.

10 Claims, 13 Drawing Sheets

(56) References Cited

U.S. PATENT DOCUMENTS

| | | | | |
|---|---|---|---|---|
| 2004/0247395 | A1* | 12/2004 | Doolaege | E02B 8/085 405/81 |
| 2007/0051417 | A1* | 3/2007 | Boettner | F16L 11/15 138/121 |
| 2008/0017499 | A1* | 1/2008 | Brockhoff | B01D 3/346 203/11 |
| 2013/0048138 | A1* | 2/2013 | Bradley, Sr. | E02B 3/127 138/155 |

* cited by examiner

GEOTEXTILE TUBE

FIELD

The disclosure relates to a geotextile tube, and more particularly to a geotextile tube that includes an extending unit for preventing damage to the geotextile tube when filling a fill material therein.

BACKGROUND

Geotextile tubes are used to form marine structures, such as jetties, groins, and dikes, or to prevent erosion to beaches or shorelines caused by waves and currents. Geotextile tubes are typically made from a geotextile material in which sands, rocks, or other fill materials are filled to create a liquid-permeable structure that is capable of absorbing impact generated by the waves and currents.

Referring to FIGS. 1 and 3, a conventional geotextile tube 9 has a tubular body 91 that surrounds a longitudinal axis. In use, the tubular body 91 is filled with a fill material, and opposite ends of the tubular body 91 along the longitudinal axis are respectively closed and sewn with two stitch seams 92. Each of the opposite ends of the tubular body 91 converges along the longitudinal axis away from the other one of the opposite ends. In order to connect two of the conventional geotextile tubes 9 end to end, adjacent ends of the two conventional geotextile tubes 9 are overlapped (see FIG. 3). However, a gap may be formed between the two conventional geotextile tubes 9, and water can easily flow through the gap, thus lowering the overall effectiveness of erosion prevention of the conventional geotextile tubes 9. In addition, since the adjacent ends of the conventional geotextile tubes 9 are not fixedly connected, the longitudinal axes of the conventional geotextile tubes 9 may be misaligned and water may easily flow therethrough, thereby also adversely affecting the effectiveness in erosion prevention.

Moreover, a plurality of the conventional geotextile tubes 9 may need to be stacked on one another so as to reach a height level for forming an effective barrier against erosion. When one of the conventional geotextile tubes 9 is placed on top of a junction between two adjacent ones of the conventional geotextile tubes 9, it may sag into the junction and result in an unlevel top surface, which adversely affects the structural strength of the stacked conventional geotextile tubes 9.

To resolve this issue, another conventional geotextile tube disclosed in U.S. Pat. No. 8,777,523 includes a tubular body, two end panels that are substantially flat and that are respectively and transversely disposed at two opposite ends of the tubular body, and a plurality of ties that are disposed on the tubular body. To connect two of such conventional geotextile tubes end to end, the end panels of such conventional geotextile tubes are aligned and the ties of one of such conventional geotextile tubes are tied together with the ties of the other one of such conventional geotextile tubes. However, water may flow through the end panels of such conventional geotextile tubes and may lead to erosion.

Furthermore, since the tubular body, the end panels, and the ties are separate individual components that are typically connected by stitching seams, puncturing of a needle through the tubular body for stitching the seams decreases the tensile strength of the tubular body at areas where the seams are located. As such, when the fill material is filled into such conventional geotextile tube, the tubular body may easily break apart at the areas where the seams are located.

Each of the seams for connecting the tubular body and the end panels is loop-shaped and may have a length greater than each of the stitch seams 92 of the conventional geotextile tube 9 illustrated in FIG. 1. Therefore, such conventional geotextile tube may be more prone to damage compared with the conventional geotextile tube 9.

Moreover, such conventional geotextile tube not only needs to withstand pressure upon filling the fill material, but also needs to bear the weight of the fill material after filling. Therefore, such conventional geotextile tube is subject to damage at the areas where the seams are located even after filling is completed, especially at where the tubular body and the end panels are connected.

Additionally, when the pressure exceeds the stress limit of the seams and such conventional geotextile tube breaks apart, the fill material may pour out from the tubular body at a relatively fast speed and may create safety concerns to people standing nearby or objects located nearby.

SUMMARY

Therefore, an object of the disclosure is to provide a geotextile tube that can alleviate at least one of the drawbacks of the prior arts.

According to the disclosure, the geotextile tube includes a bag unit, an extending unit, a main stitch seam, and at least two auxiliary stitch seams. The bag unit includes a tubular wall that surrounds an axis, an end wall that is disposed transversely at one end of the tubular wall, and that cooperates with the tubular wall to define a filling space therein. The extending unit is connected to the end wall, and includes two extending parts that respectively and outwardly extend from opposite lateral sides of the end wall. Each of the extending parts defines a buffering space. The main stitch seam extends from one of the extending parts to the other one of the extending parts through the end wall so as to seal the filling space and the buffering space of each of the extending parts. The at least two auxiliary stitch seams intersect the main stitch seam, and are respectively disposed at the lateral sides of the end wall, such that the end wall is formed to be substantially flat. Each of the at least two auxiliary stitch seams separates an adjacent one of the buffering spaces from the filling space.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
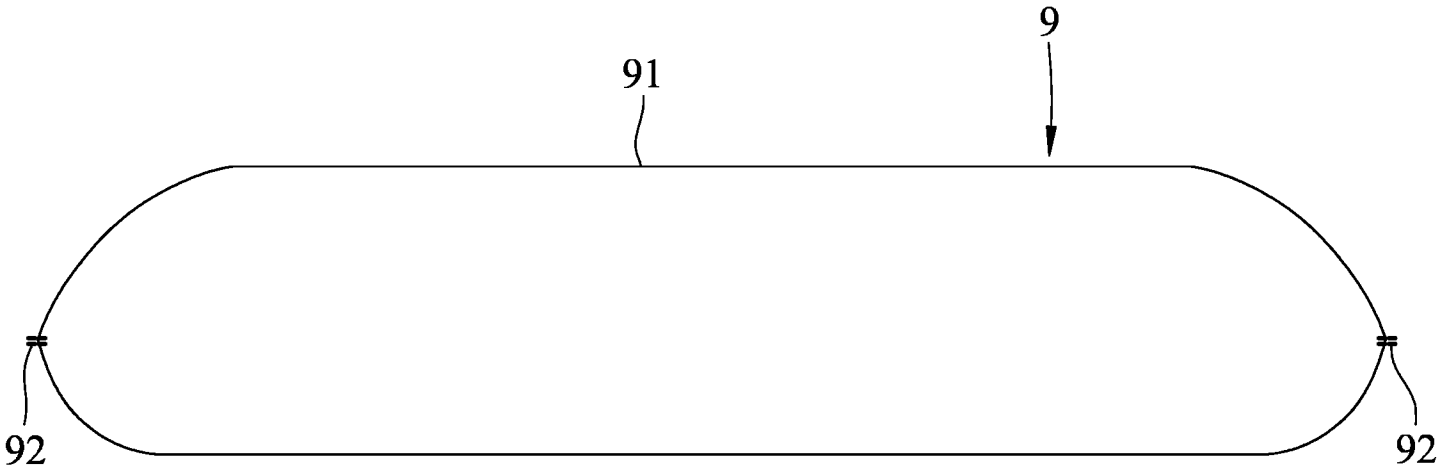
FIG.1 PRIOR ART
FIG. 1 is a front view of a conventional geotextile tube.
Figure 2:
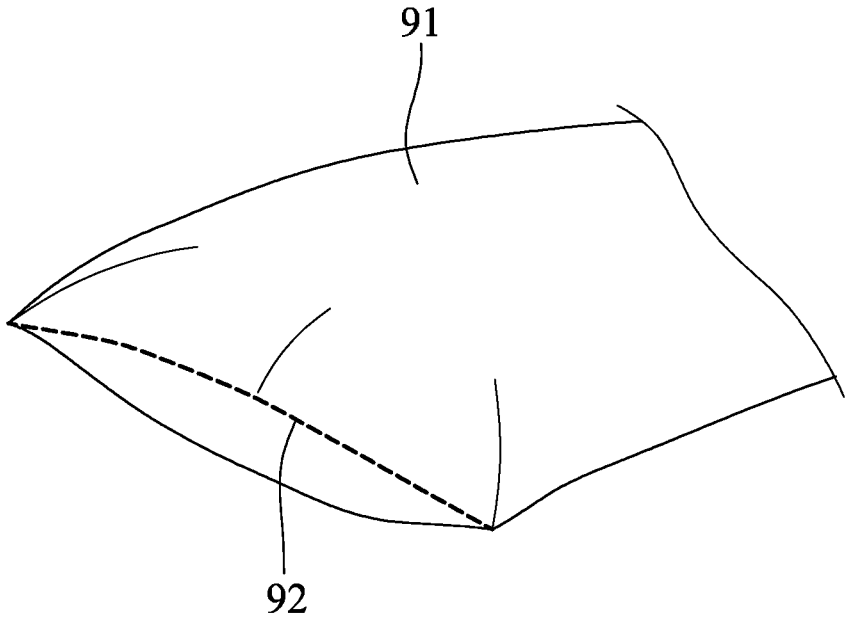
FIG.2 PRIOR ART
FIG. 2 is a fragmentary perspective view of the conventional geotextile tube.
Figure 3:
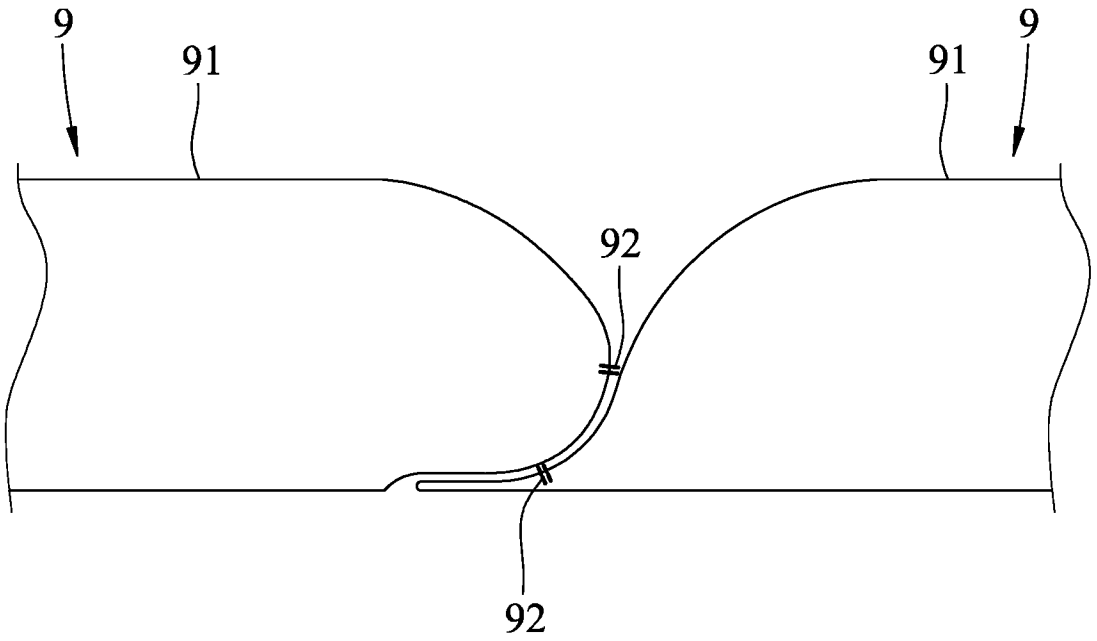
FIG.3 PRIOR ART
FIG. 3 is a fragmentary schematic view illustrating that two of the conventional geotextile tubes are connected end to end.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 4:
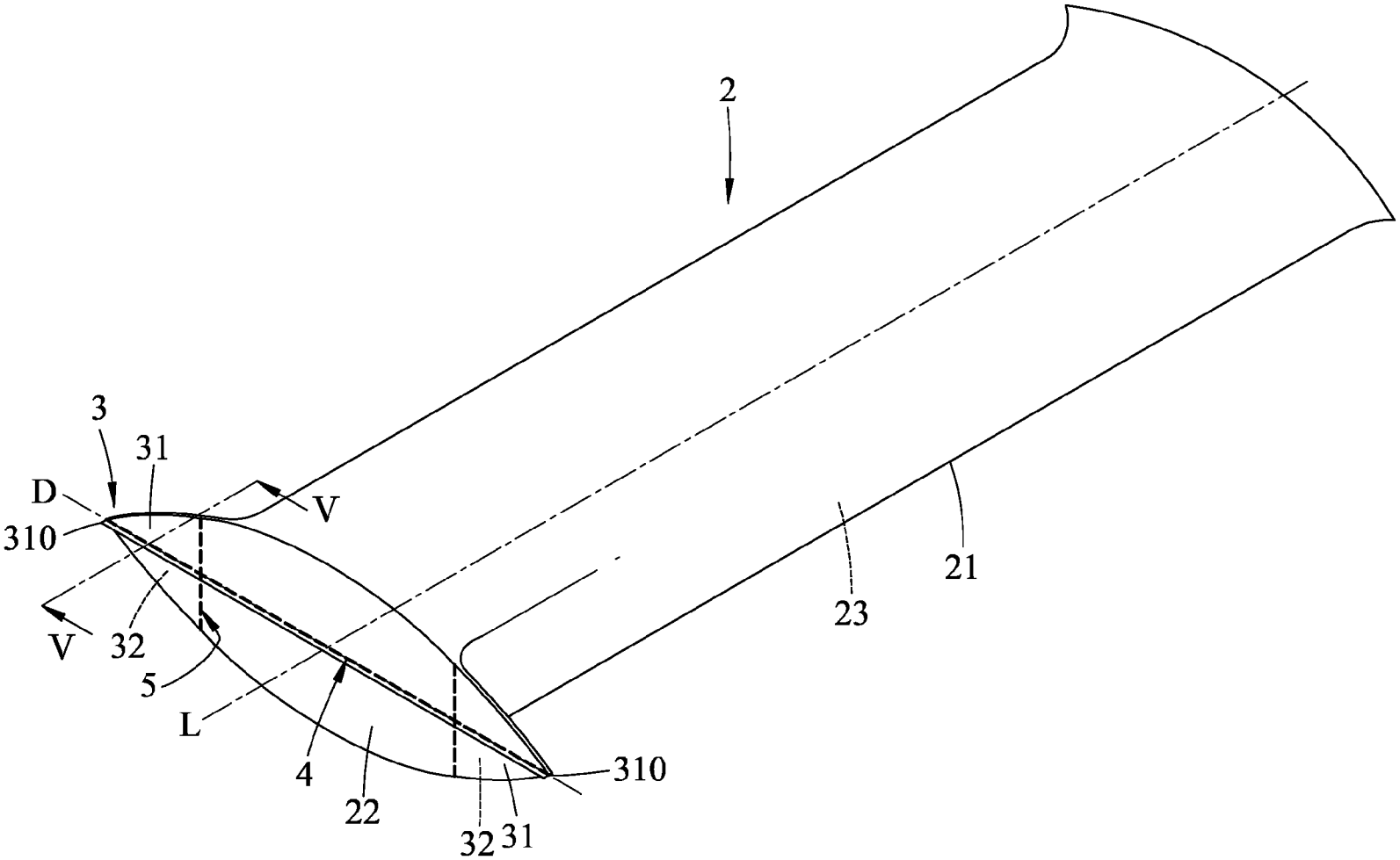
FIG. 4 is a perspective view illustrating a first embodiment of a geotextile tube according to the disclosure.
Figure 5:
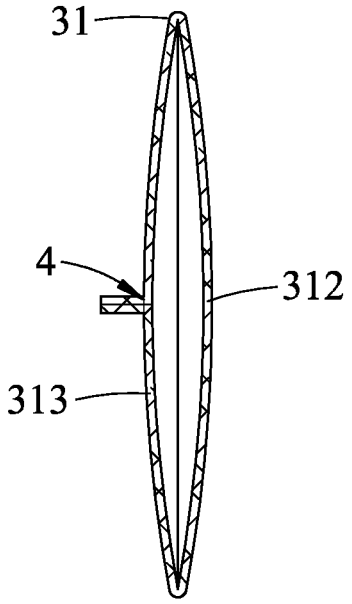
FIG. 5 is a sectional view taken along line V-V in FIG. 4, illustrating structure of an extending part of an extending unit of the first embodiment.
Figure 6:
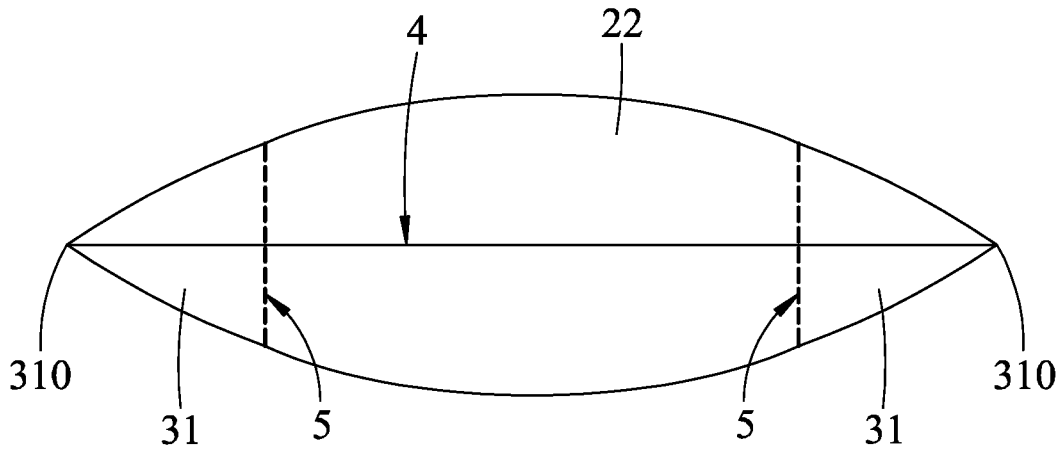
FIG. 6 is a side view of the first embodiment.

Referring to FIGS. 4 to 6, a first embodiment of a geotextile tube according to the disclosure includes a bag unit 2, an extending unit 3, a main stitch seam 4, and two auxiliary stitch seams 5.

The bag unit 2 includes a tubular wall 21 and an end wall 22. The tubular wall 21 surrounds an axis (L). The end wall 22 is disposed transversely at one end of the tubular wall 21, is substantially flat, and cooperates with the tubular wall 21 to define a filling space 23 therein.

The extending unit 3 is connected to the end wall 22, and includes two extending parts 31 that respectively and outwardly extend from opposite lateral sides of the end wall 22. Each of the extending parts 31 defines a buffering space 32.

More specifically, the extending parts 31 respectively have tapering ends 310 that are distal from the end wall 22. Each of the extending parts 31 has first and second layers 312, 313 (see FIG. 5) bounding a corresponding one of the buffering spaces 32 and interconnected along a corresponding one of the auxiliary stitch seams 5. The first layer 312 extends from the tubular wall 21, and the second layer 313 extends from the end wall 22.

The main stitch seam 4 extends from one of the extending parts 31 to the other one of the extending parts 31 through the end wall 22 so as to seal the filling space 23 and the buffering space 32 of each of the extending parts 31. To be more specific, the main stitch seam 4 extends from one of the tapering ends 310 of the extending parts 31 to the other one of the tapering ends 310 of the extending parts 31 along a diametric line (D) with respect to the axis (L) of the tubular wall 21, as illustrated in FIG. 4.

The auxiliary stitch seams 5 intersect the main stitch seam 4, and are respectively disposed at the lateral sides of the end wall 22. The tapering end 310 of each of the extending parts 31 is distal from a corresponding one of the auxiliary stitch seams 5. Each of the auxiliary stitch seams 5 separates an adjacent one of the buffering spaces 32 of the extending unit 3 from the filling space 23, and has a seam strength lower than that of the main stitch seam 4.

As shown in FIG. 6, in this embodiment, the main stitch seam 4 is a straight stitch line. Each of the auxiliary stitch seams 5 is a straight stitch line perpendicular to the main stitch seam 4. As such, the end wall 22 is substantially flat and has a substantially rectangular shape. The geotextile tube formed after filling a fill material (not shown) therein has a substantially rectangular cuboid shape at where the end wall 22 is located and is thus easily stackable.

During an operation for filling the fill material (not shown) into the filling space 23, pressure is exerted on the end wall 22, the main stitch seam 4, and the auxiliary stitch seams 5. When the pressure exceeds the stress limit of the auxiliary stitch seams 5, at least one of the auxiliary stitch seams 5 may break, which results in moving of the fill material into a corresponding one of the buffering spaces 32 and expansion of a corresponding one of the extending parts 31 of the extending unit 3. Such change is readily apparent, thereby alerting an operator that the pressure is too high, so that the operator can stop filling the fill material or reduce the speed of filling before the geotextile tube is damaged due to the pressure.

In addition, since the end wall 22 is substantially flat after the filling operation is completed, the pressure is distributed evenly to an entire surface of the end wall 22, and the pressure exerted on the main stitch seam 4 is reduced compared to that of the above-mentioned conventional geotextile tube having converging ends, thereby preventing the main stitch seam 4 from breaking apart.

Figure 7:
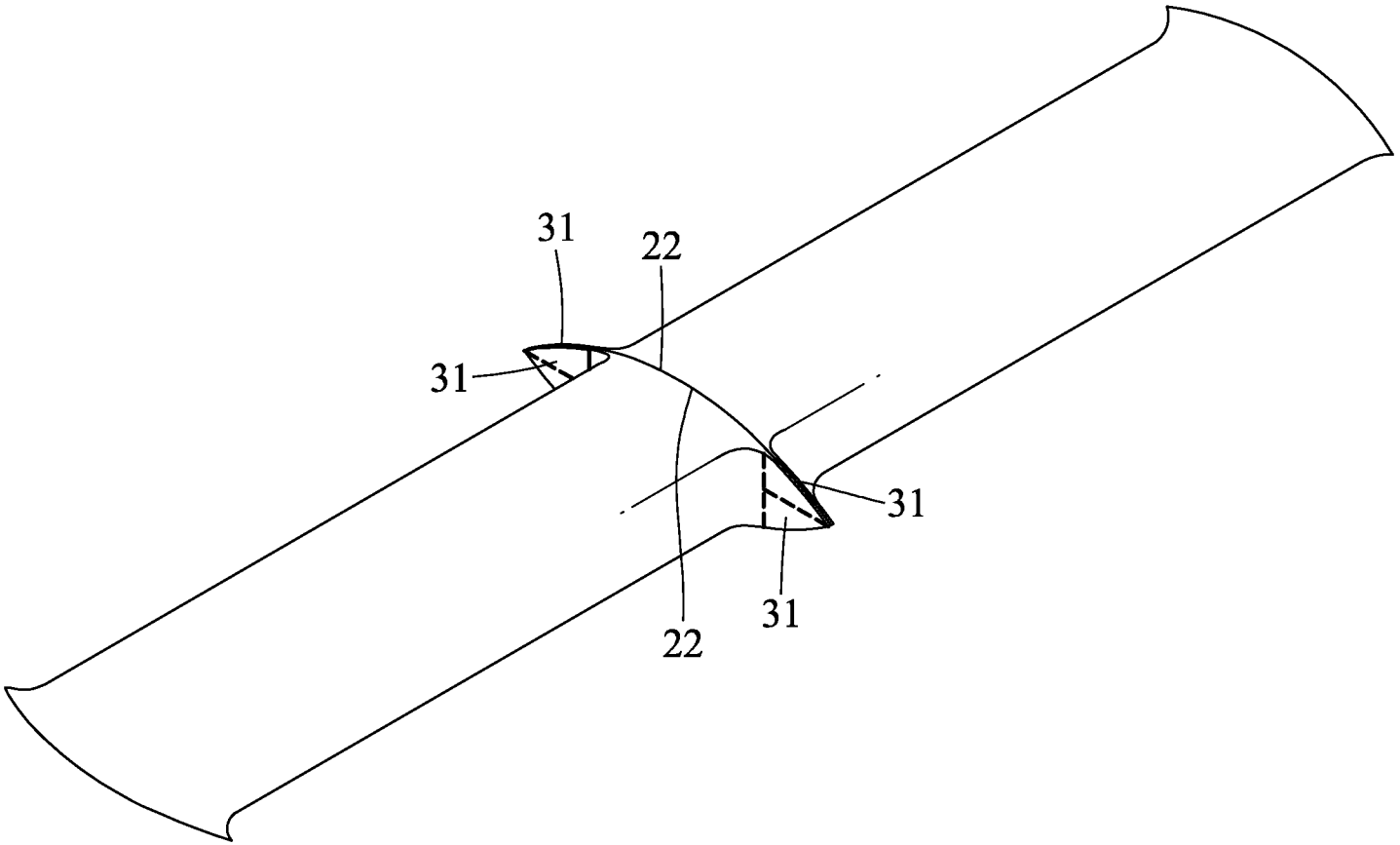
FIG. 7 is a perspective view illustrating that two of the geotextile tubes of the first embodiment are connected end to end.
Figure 8:
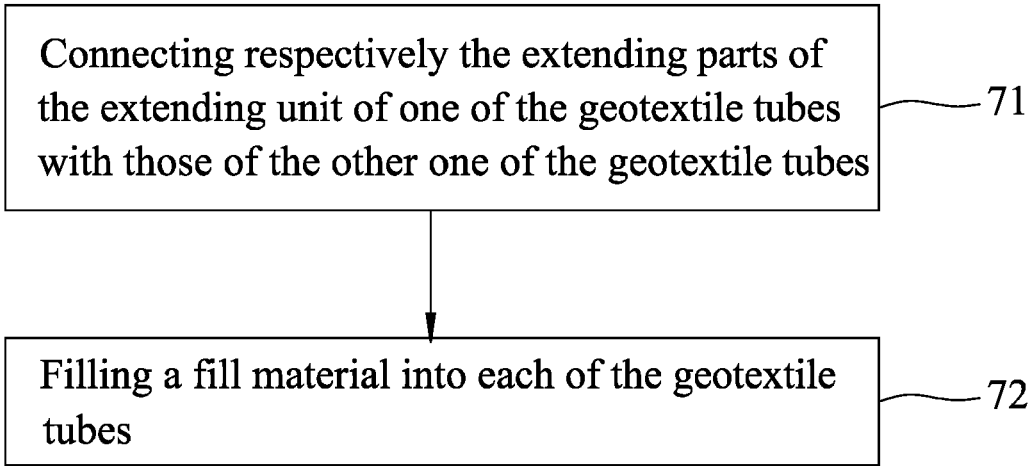
FIG. 8 is a flow chart of a method of connecting two of the geotextile tubes of the first embodiment.

Referring to FIGS. 4, 7, and 8, a method of connecting two of the geotextile tubes includes steps 71 and 72.

In the step 71, the extending parts 31 of the extending unit 3 of one of the geotextile tubes are respectively connected to those of the other one of the geotextile tubes by one of the following techniques: stitching, using an adhesive material, or forming holes on the extending parts 31 of the geotextile tubes and extending a tying strap through the holes followed by tying the tying strap. It should be noted that the structural integrity of each of the geotextile tubes is not affected by the connection between the extending parts 31 of the geotextile tubes.

In the step 72, the fill material is filled into each of the geotextile tubes. Since the geotextile tubes are aligned when the extending parts 31 of the geotextile tubes are connected, a problem associated with aligning two heavy individually-filled geotextile tubes is eliminated.

In certain embodiments, the sizes of the geotextile tubes are the same, so that the end walls 22 of the geotextile tubes can be easily registered with each other via the alignment between the extending parts 31 of the geotextile tubes.

Figure 9:
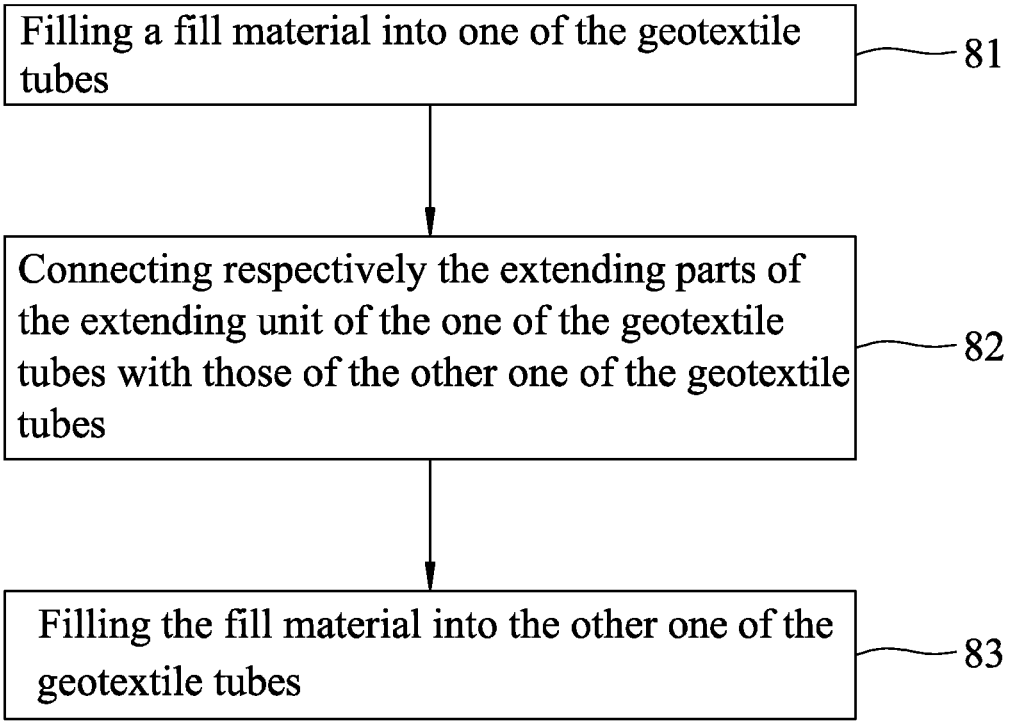
FIG. 9 is a flow chart of another method of connecting two of the geotextile tubes of the first embodiment.

Referring to FIGS. 4, 7, and 9, another method of connecting two of the geotextile tubes includes steps 81 to 83.

In the step 81, one of the geotextile tubes is filled with the fill material.

In the step 82, the extending parts 31 of the one of the geotextile tubes are connected respectively to the extending parts 31 of the other one of the geotextile tubes.

In the step 83, the other one of the geotextile tubes is filled with the fill material. With the one of the geotextile tubes being filled with the fill material, the operator can make certain that, after the other one of the geotextile tubes is properly spread out on the ground before filling of the fill material therein, difficulty in expanding to full volume of the other one of the geotextile tubes due to the weight of the fill material filled in the one of the geotextile tubes can be prevented.

It is worth mentioning that in certain embodiments, the geotextile tube may include two of the end walls 22 disposed transversely and respectively at two opposite ends of the tubular wall 21, and two of the extending units 3 respectively connected to the end walls 22.

In summary, when two of the geotextile tubes are connected, by virtue of the configuration of the end wall 22 being substantially flat, the end wall 22 of one of the geotextile tubes contacts the end wall 22 of the other one of the geotextile tubes without forming a gap therebetween, and possibility of damage of the main stitch seams 4 of the geotextile tubes is effectively reduced. Comparing with the above-mentioned conventional geotextile tube disclosed in U.S. Pat. No. 8,777,523, the connection of the connecting units of the two geotextile tubes effectively prevents water from flowing through the two geotextile tubes and thus forms a shield against erosion caused by waves and currents. Moreover, by virtue of the seam strength of each of the auxiliary stitch seams 5 being lower than that of the main stitch seam 4, the auxiliary stitch seams 5 may break apart before the main stitch seam 4 breaks apart, which alerts the operator and further reduces the possibility of damage of the main stitch seam 4.

Figure 10:
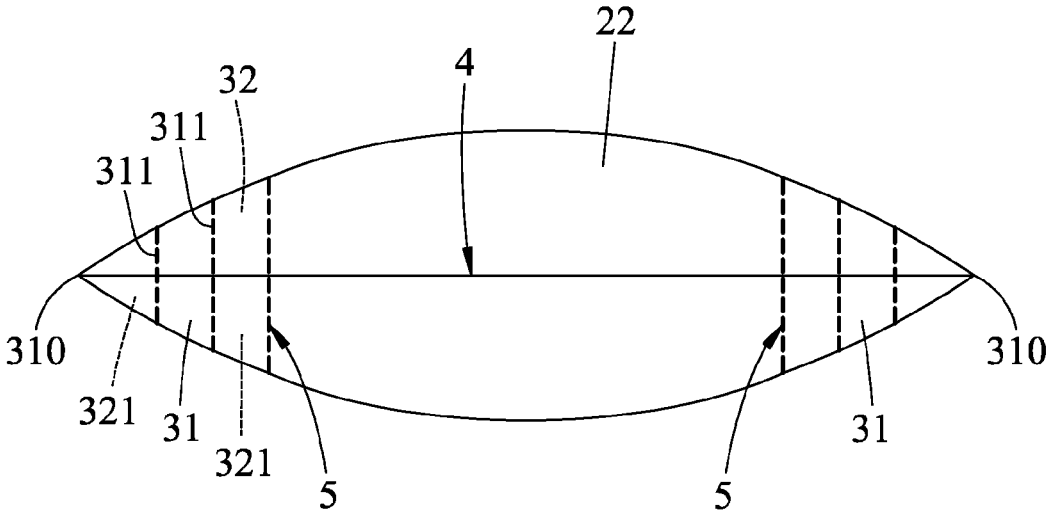
FIG. 10 is a side view of a second embodiment of the geotextile tube according to the disclosure.

Referring to FIG. 10, a second embodiment of the geotextile tube according to the disclosure is similar in structure to the first embodiment. The difference between the first and second embodiments resides in that each of the extending parts 31 of the second embodiment further includes a set of spaced-apart sub-stitch seams 311 intersecting the main stitch seam 4 between the corresponding one of the tapering ends 310 and the corresponding one of the auxiliary stitch seams 5, and dividing the buffering space 32 of a corresponding one of the extending parts 31 into a plurality of divided zones 321. In this embodiment, the set of the spaced-apart sub-stitch seams 311 of each of the extending parts 31 has two of the sub-stitch seams 311 which divide the corresponding one of the extending parts 31 into three divided zones 321.

Each of the auxiliary stitch seams 5 of the second embodiment has a seam strength lower than that of each of the sub-stitch seams 311 of the corresponding one of the extending parts 31. The set of the sub-stitch seams 311 of each of the extending parts 31 gradually decreases in seam strength from the corresponding one of the tapering ends 310 toward the corresponding one of the auxiliary stitch seams 5.

During the filling operation, when the pressure exceeds the stress limit of the auxiliary stitch seams 5, at least one of the auxiliary stitch seams 5 may break and thereby resulting in moving of the fill material into one of the divided zones 321 which is adjacent to the filling space 23, and alerting the operator that the pressure exceeds the stress limit of the at least one of the auxiliary stitch seams 5. As the pressure continues to build up, one of the sub-stitch seams 311 which is adjacent to the filling space 23 may break, alerting the operator that the pressure exceeds the stress limit of the one of the sub-stitch seams 311. Since the sub-stitch seams 311 of each of the extending parts 31 have an increase in seam strength from the corresponding one of the auxiliary stitch seams 5 toward the corresponding one of the tapering ends 310, multiple alerts are given to the operator. Therefore, the possibility of damage of the geotextile tube is further reduced.

Figure 11:
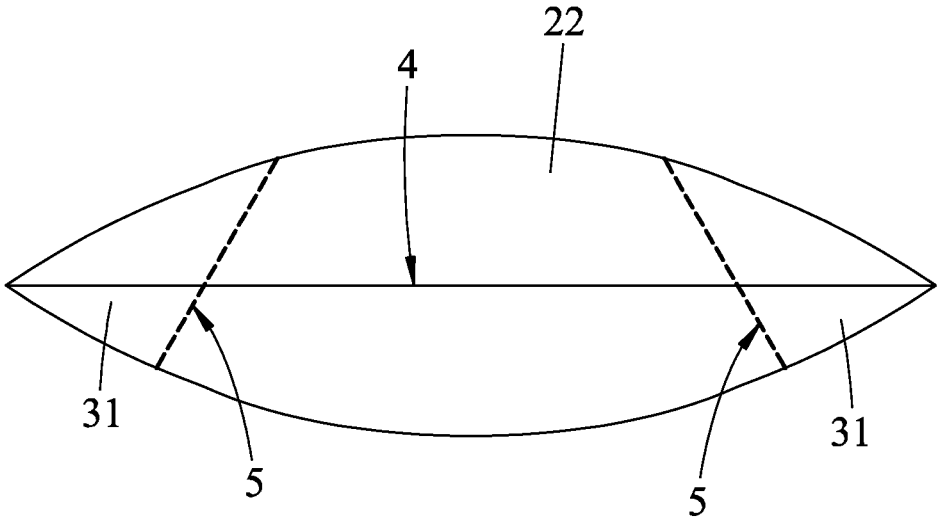
FIG. 11 is a side view of a third embodiment of the geotextile tube according to the disclosure.

Referring to FIG. 11, a third embodiment of the geotextile tube according to the disclosure is similar in structure to the first embodiment. The difference between the first and third embodiments resides in that each of the auxiliary stitch seams 5 of the third embodiment is a straight stitch line non-perpendicular to the main stitch seam 4, and is configured such that the end wall 22 of the third embodiment has a substantially trapezoid shape. As such, the geotextile tube of the third embodiment may be easily stackable, and may assist in guiding flow of waves and currents upward so as to prevent erosion to a foundation on which the geotextile tubes are piled up.

Figure 12:
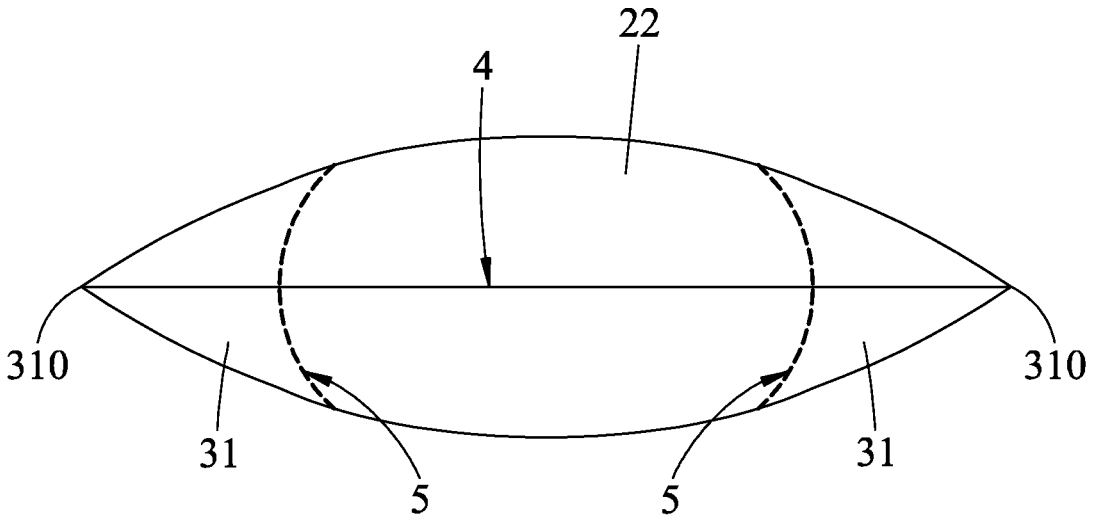
FIG. 12 is a side view of a fourth embodiment of the geotextile tube according to the disclosure.

Referring to FIG. 12, a fourth embodiment of the geotextile tube according to the disclosure is similar in structure to the first embodiment. The difference between the first and fourth embodiments resides in that each of the auxiliary stitch seams 5 of the fourth embodiment is a curved stitch line that is convex toward a respective one of the tapering ends 310. As such, the stress exerted on the end wall 22 is distributed relatively evenly, thereby reducing the possibility of damage of the geotextile tube.

Figure 13:
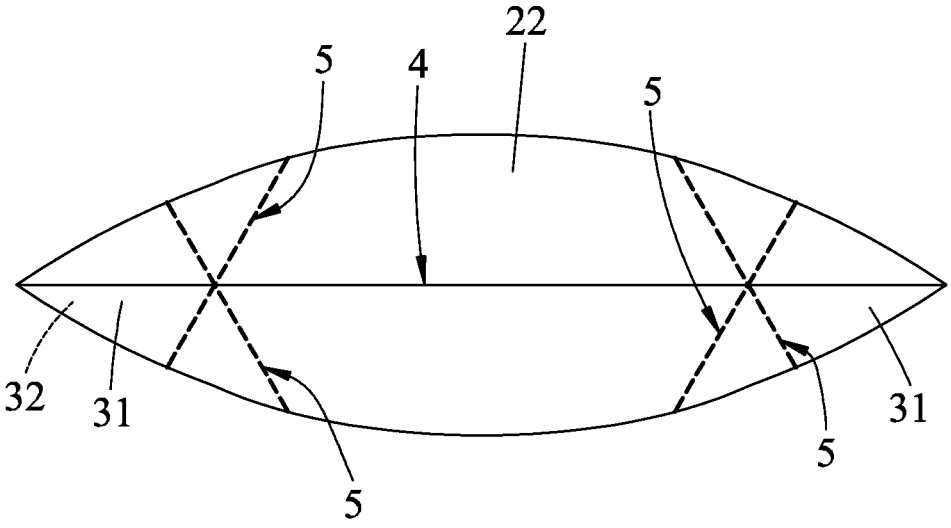
FIG. 13 is a side view of a fifth embodiment of the geotextile tube according to the disclosure.

Referring to FIG. 13, a fifth embodiment of the geotextile tube according to the disclosure is similar in structure to the first embodiment. The difference between the first and fifth embodiments resides in that the geotextile tube of the fifth embodiment includes four of the auxiliary stitch seams 5. Each two of the auxiliary stitch seams 5 intersect each other and further intersect the main stitch seam 4 at one of the lateral sides of the end wall 22. An intersection point of each two of the auxiliary stitch seams 5 is located on the main stitch seam 4. The end wall 22 of the fifth embodiment is substantially hexagonal in shape, such that the stress exerted on the end wall 22 is distributed relatively evenly, thereby reducing the possibility of damage of the geotextile tube. In this embodiment, the auxiliary stitch seams 5 are directly stitched on the end wall 22 and the extending parts 31.

It should be noted that in a variation of the above-mentioned embodiments, each of the auxiliary stitch seams 5 may have a seam strength equal to that of the main stitch seam 4, so that formations of the auxiliary stitch seams 5 and the main stitch seam 4 are facilitated. The end wall 22 is formed to be substantially flat in the same manner as the above-mentioned embodiments. Therefore, similar damage prevention and easily stackable function as the above-mentioned embodiments may be achieved.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A geotextile tube comprising:

a bag unit including a tubular wall that surrounds a longitudinal axis along a length of said geotextile tube, an end wall that is disposed transversely at one end of said tubular wall, and that cooperates with said tubular wall to define a filling space therein;

an extending unit connected to said end wall, and including two extending parts that respectively and outwardly extend from opposite lateral sides of said end wall, each of said extending parts defining a buffering space;

a main stitch seam extending from one of said extending parts to the other one of said extending parts through said end wall so as to seal said filling space and said buffering space of each of said extending parts; and at least two auxiliary stitch seams intersecting said main stitch seam, and respectively disposed at said lateral sides of said end wall such that said end wall is formed to be substantially flat, each of said at least two auxiliary stitch seams separating an adjacent one of said buffering spaces from said filling space.

2. The geotextile tube as claimed in claim 1, wherein each of said at least two auxiliary stitch seams has a seam strength lower than that of said main stitch seam.

3. The geotextile tube as claimed in claim 1, wherein each of said extending parts of said extending unit includes one end distal from a corresponding one of said at least two auxiliary stitch seams, and a set of spaced-apart sub-stitch seams intersecting said main stitch seam between said one end and the corresponding one of said at least two auxiliary stitch seams, and dividing said buffering space of a corresponding one of said extending parts into a plurality of divided zones.

4. The geotextile tube as claimed in claim 3, wherein each of said at least two auxiliary stitch seams has a seam strength lower than that of each of said sub-stitch seams of the corresponding one of said extending parts.

5. The geotextile tube as claimed in claim 4, wherein said set of said sub-stitch seams of each of said extending parts gradually decreases in seam strength from said one end toward the corresponding one of said at least two auxiliary stitch seams.

6. The geotextile tube as claimed in claim 1, wherein said main stitch seam is a straight stitch line, each of said at least two auxiliary stitch seams being a straight stitch line perpendicular to said main stitch seam.

7. The geotextile tube as claimed in claim 1, wherein said main stitch seam is a straight stitch line, each of said at least two auxiliary stitch seams being a straight stitch line non-perpendicular to said main stitch seam.

8. The geotextile tube as claimed in claim 1, wherein said main stitch seam is a straight stitch line, each of said at least two auxiliary stitch seams being a curved stitch line.

9. The geotextile tube as claimed in claim 1, wherein:

said main stitch seam is a straight stitch line; and said at least two auxiliary stitch seams include four of said auxiliary stitch seams, each two of said auxiliary stitch seams intersecting each other and further intersecting said main stitch seam at one of said lateral sides of said end wall, an intersection point of each two of said auxiliary stitch seams being located on said main stitch seam.

10. The geotextile tube as claimed in claim 1, wherein said extending parts respectively have tapering ends that are distal from said end wall, said main stitch seam extending from one of said tapering ends to the other one of said tapering ends along a diametric line with respect to the longitudinal axis of said tubular wall, each of said extending parts having first and second layers bounding a corresponding one of said buffering spaces and interconnected along a corresponding one of said at least two auxiliary stitch seams, said first layer extending from said tubular wall, said second layer extending from said end wall.

* * * * *